US005662093A

United States Patent [19]

DenHerder

[11] Patent Number: 5,662,093

[45] Date of Patent: Sep. 2, 1997

[54] TORQUE SIGHT FOR HAND-HELD BOWS

[76] Inventor: Marvin J. DenHerder, 816 Brookwood Dr., Olympia Fields, Ill. 60461

[21] Appl. No.: 661,678

[22] Filed: Jun. 11, 1996

Related U.S. Application Data

[63] Continuation-in-part of Ser. No. 353,766, Dec. 12, 1994, abandoned.

[51] Int. Cl.[6] ..... F41B 5/00; F41G 1/467

[52] U.S. Cl. ..... 124/23.1; 124/86; 124/87

[58] Field of Search ..... 124/23.1, 24.1, 124/25.6, 86, 87, 88; 33/265

[56] References Cited

U.S. PATENT DOCUMENTS

| | | | |
|---|---|---|---|
| 3,641,675 | 2/1972 | Funk | 33/265 |
| 4,116,194 | 9/1978 | Topel | 124/87 |
| 4,179,613 | 12/1979 | Koren | 124/87 X |
| 4,552,121 | 11/1985 | Treaster | 124/87 |
| 4,848,306 | 7/1989 | Treaster | 33/265 X |
| 4,961,264 | 10/1990 | Topel | 33/265 |
| 5,175,937 | 1/1993 | Emerson | 124/88 X |

*Primary Examiner*—John A. Ricci
*Attorney, Agent, or Firm*—Philip Hill

[57] ABSTRACT

Apparatus to provide improved archery accuracy, by correcting bow handle twist problems, includes: a bar, attached to the bow handle parallel to the position of the arrow; an elastic cord, band, or tube, attached at one end to a front portion of the bar and at the other end to the bow string at a point which aligns the elastic cord with the bar when the bow is at full draw. Slight twisting of the bow handle causes a lateral movement of the rear portion of the bar relative to the elastic cord. Observation of this movement by the archer permits him to change his grip of the bow handle to eliminate the twist and thus improve accuracy. Observation of such movement of the rear portion of the bar is enhanced by placing a small plate at the rear end of the bar together with a pointer on a pivot pin. Other improvements include use of electrical contacts and lights to indicate the presence or absence of twist. When indicator lights are used, a portion of the elastic cord may be replaced with a conductor, such as a copper wire, to improve sensitivity to twist. Electrical contact gaps to either left or right sides may define a gap of only 0.0005 to 0.02 inch and thus provide exceptional sensitivity to either right or left bow handle twist.

12 Claims, 5 Drawing Sheets

FIG. 7
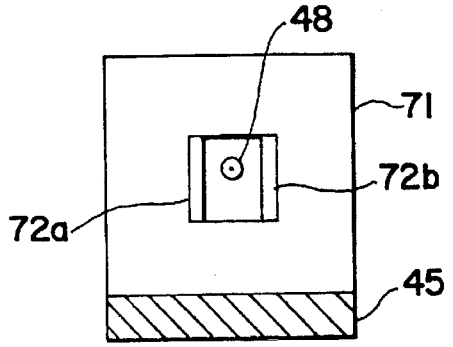
FIG. 8
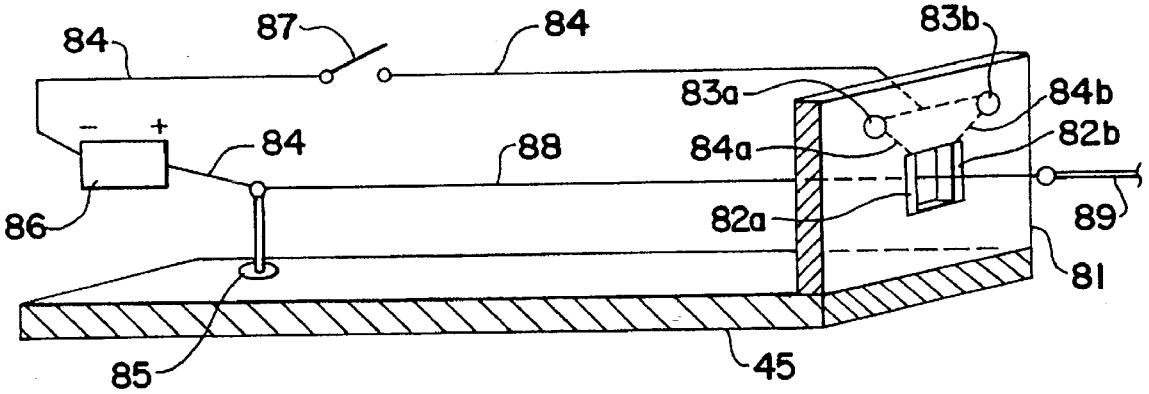
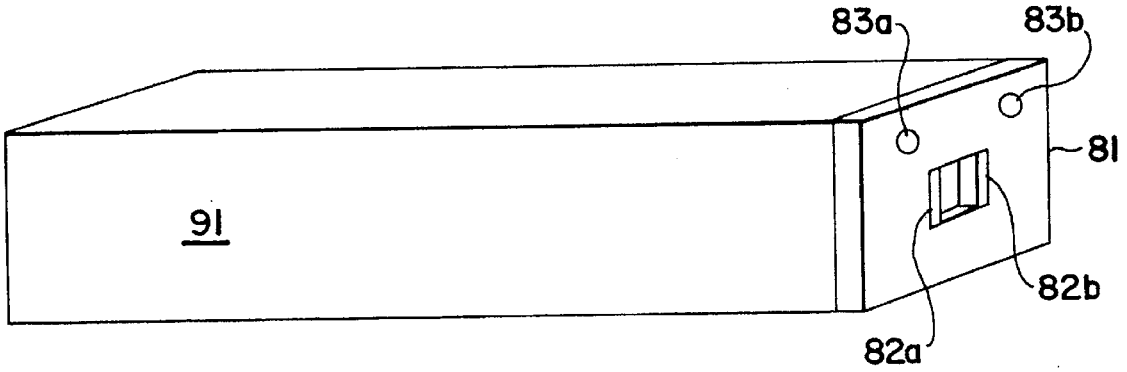
FIG. 9

TORQUE SIGHT FOR HAND-HELD BOWS

This is a continuation-in-part of application Ser. No.08/353,766 filed on Dec. 12, 1994, now abandoned.

BACKGROUND OF THE INVENTION

This invention relates to an apparatus for attachment to hand-held bows to provide improved sighting accuracy for the archer. It is useful both with simple bows and with compound bows, employing cables and pulleys.

Accuracy associated with the bow has customarily emphasized sighting systems for distance parameters. Typical sighting systems may employ cross-hairs, sight pins, scopes, laser sights, and the like. Many solutions for such sighting problems employing a great variety of degrees of sophistication, are available from a number of suppliers.

Accuracy is also recognized as being a function of bow handle torque, or twist, in the hand of the bowman. It is well recognized that whenever the bow handle is twisted, accuracy is poor. For example, when the archers hand twists the bow handle to the right, the sight direction to the target shifts to the right of the arrow flight direction, causing the arrow to miss to the left of the target. Similarly, a twist to the left will cause the arrow to miss to the right of the target. Whenever sights, such as pins, cross-hairs, scopes, or lasers, are attached to the bow handle, poor accuracy due to torque, or twist, is generally enhanced.

Corrective apparatus for the bow handle twist problem is commercially available. One approach is a handle design that reduces the tendency of the archer to twist the handle.

Another approach involves the attachment of a bar to the bow handle, the bar providing front and rear sections such as front and rear rifle sights or front and rear cross-hairs. Sighting is done by eye in the same manner used when shooting rifles or handguns. Such sights are difficult to use and accuracy problems persist. The use of systems involving cables and pulleys with compound bows is described in, for example, U.S. Pat. No. 3,486,495 and in U.S. Pat. No. 4,054,118.

There remains an extensive and serious problem in the sighting accuracy of archery bows, brought about by a relatively slight degree of torque, or twist, applied to the bow handle by the archer.

SUMMARY OF THE INVENTION

It is the primary objective of this invention to provide simple and effective means for improving the accuracy of an archery bow, particularly in response to twist of the bow handle as a consequence of its grip by the archer. The intent is to make the archer aware of such twist, or torque, changes so that correction of the twist or torque may be made prior to the release of the arrow. This objective is achieved by attaching a bar, having front and rear sections, to the bow handle to receive an elastic line, fixed at its front end to the front section of the bar, directed along or through the rear section of the bar, and fixed at its rear end to the bowstring. The point of fixation to the bow string is selected so that the elastic line will be approximately parallel to the arrow when the bow is at full draw. Various signal means may be employed at or near the rear section of the bar to indicate whether the elastic line, and the bar, are in proper alignment or are out of alignment due to bow handle twist. In this manner the archer is made aware of torque shifts either to the left or to the right, as well as of the desired absence of any torque shift.

It is another object of this invention to provide effective illuminated signals for indicating the presence of a torque shift or its absence.

It is still another object of this invention to provide refined signal means capable of measuring shifts in the position of the elastic line relative to the rear section of the bar as small as about 0.0005 inch.

Other objects of this invention will become apparent in the course of the following description and discussion.

BRIEF DESCRIPTION OF THE DRAWINGS

Illustrative of the invention, in part, are the following drawings.

FIGS. 5, 6, and 7 present expanded, cross-sectional views of various modifications of the rear section of the bar to afford, in part, the signal means of this invention.

FIGS. 8, 9, and 10 present the other claimed features relating to electrical contacts, lights, and power source.

DETAILED DESCRIPTION OF THE INVENTION

The invention of this disclosure relates to an improved apparatus for incorporation in hand-held bows, addressing the persistent problem of torque, or twist, associated with the grasp of the bow handle by the archer. The apparatus of this invention improves accuracy by visibly indicating when the bow handle is twisted either to the right or to the left, thus permitting the archer to change his grip and adjust the bow handle to the desired, no-twist, center position.

Figure 1:
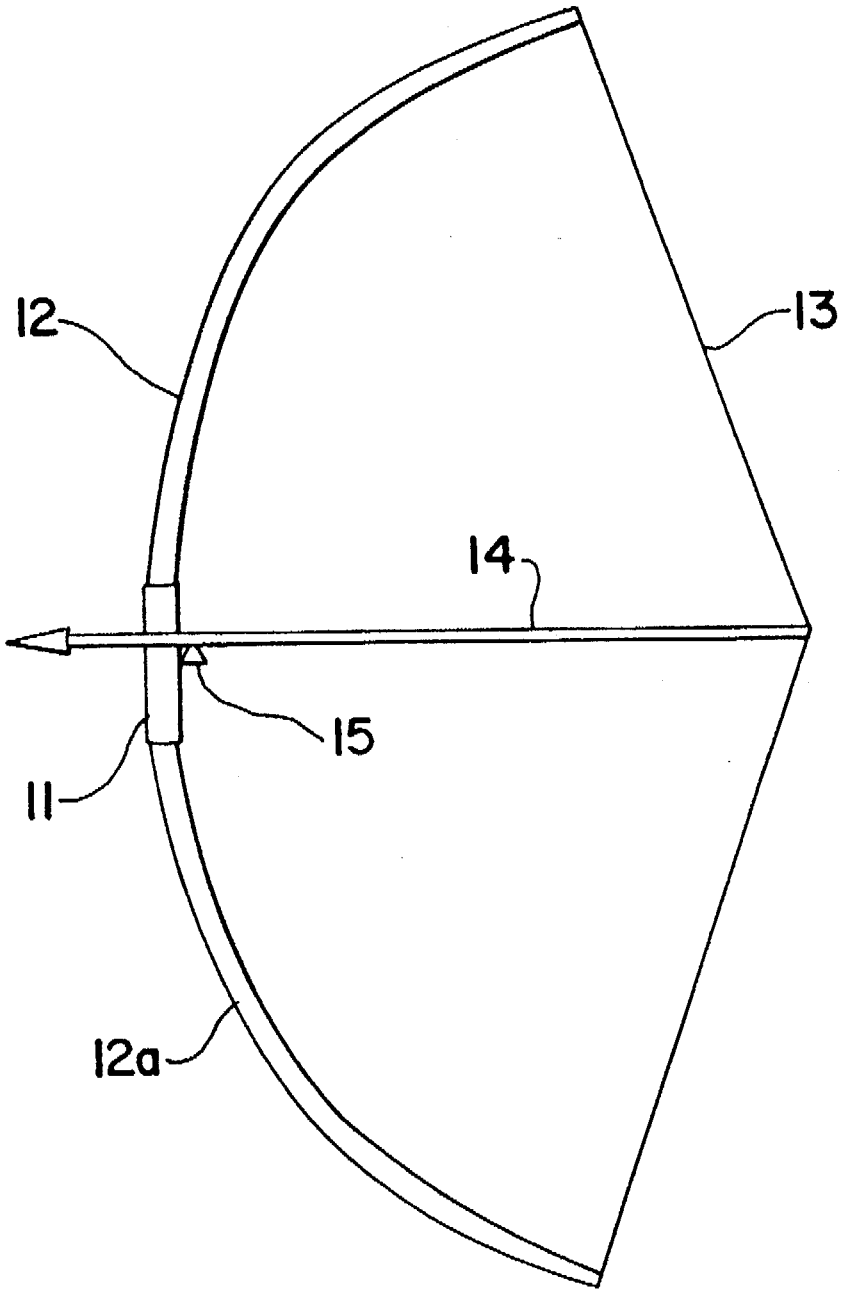
FIG. 1 PRIOR ART
FIG. 1 is a side elevational view of a simple prior art bow arrangement.

Essential components of a simple archery bow, shown in FIG. 1, include bow handle 11, bow limbs 12 and 12*a* extending from the bow handle, and bow string 13 attached to the extended ends of the respective bow limbs. In preparation for use, an arrow 14 is notched on bow string 13 and is positioned on arrow rest 15 which is attached to bow handle 11.

Figure 2:
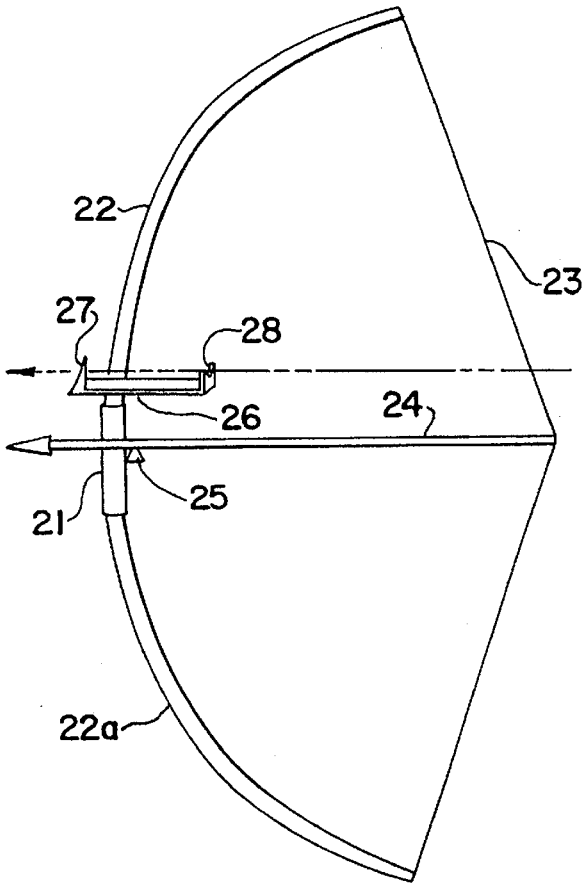
FIG. 2 PRIOR ART
FIG. 2 is illustrative of the use of simple sights in a simple prior art bow arrangement.
Figure 3:
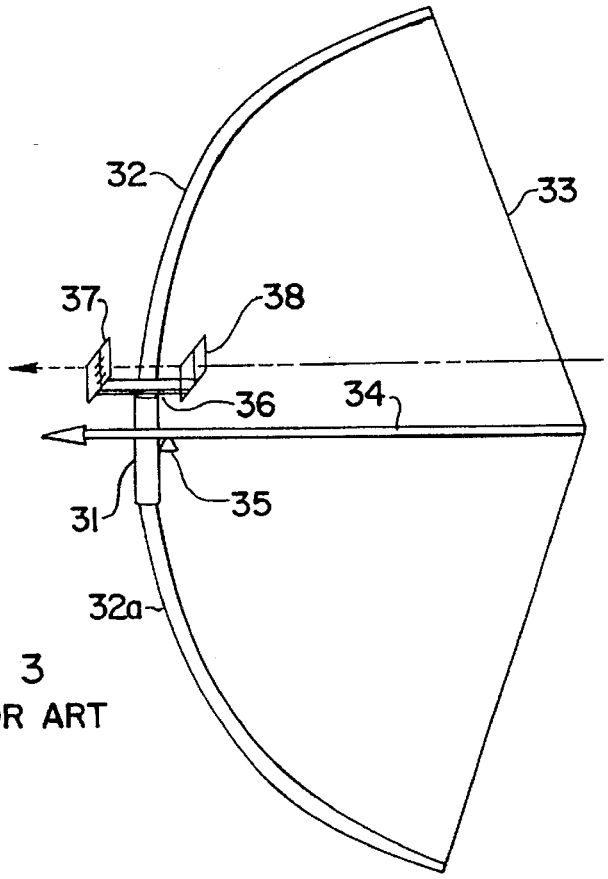
FIG. 3 PRIOR ART
FIG. 3 is similarly illustrative of the prior art use of cross-hair sights.

Even a slight torque in the bow handle can cause sufficient disparity between the sight direction toward the target and the flight direction of the released arrow to result in a miss of the target. Previous attempts to avoid the torque problem have included the attachment, shown in FIG. 2, of a bar 26 to bow handle 21. Typical bow limbs 22 and 22*a*, and bow string 23, arrow 24, and arrow rest 25, are conventional. Bar 26 is fitted with a front rifle sight 27 and a rear rifle sight 28. A similar approach, shown in FIG. 3, includes bow handle 31, bow limbs 32 and 32*a*, bow string 33, and arrow rest 35, with bar 36 fitted to bow handle 31. In this approach bar 36 is fitted with front cross-hair sight 37 and rear vertical hair sight 38. The use of either rifle sights or cross-hair sights serves as an aid to reduce torque by alignment of front and rear sights by eye.

Figure 4:
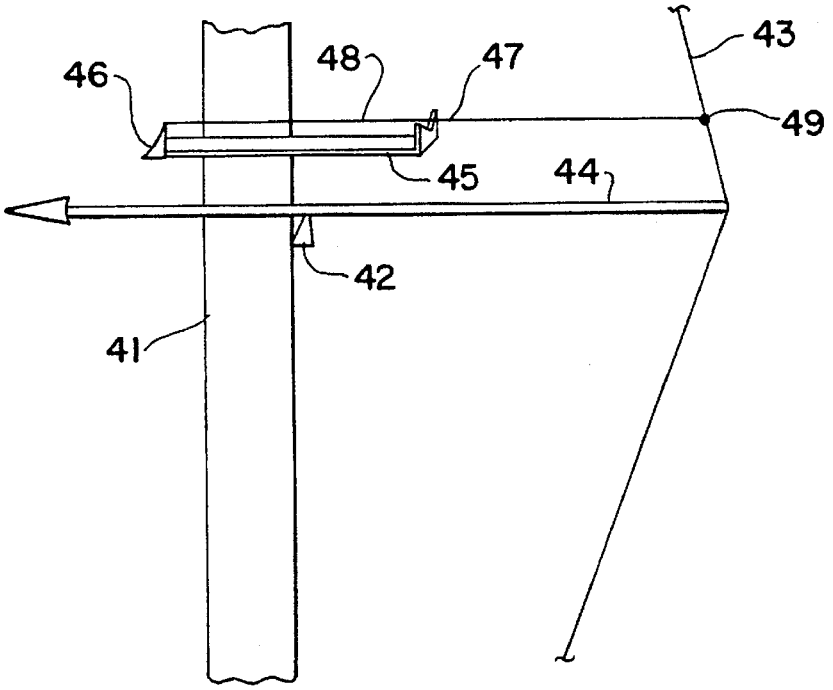
FIG. 4 is a partial side elevational view illustrative of the basic elements of this invention.
Figure 5:
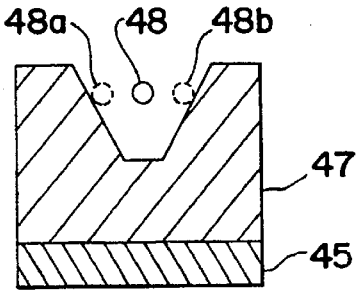

The basic elements of the invention of this disclosure, constituting significant and desirable further improvement in the control of the torque problem, are shown in FIG. 4. In this embodiment, bow handle 41, arrow rest 42, and bow string 43, serve to position arrow 44. Bar 45 is fitted with front section 46 and rear section 47. Instead of aligning the front and rear sights by eye to achieve zero torque, an elastic cord 48 is anchored to front section 46, passed through the opening in rear section 47, and extended to bow string 43 at connecting point 49. When the bow is at full draw, adjustments may be made to the attachment of elastic cord 48 at both ends 46 and 49 to cause cord 48 to be centered in the rear section 47 when torque is zero. With reference to FIG. 5, being a cross-sectional view of one embodiment of the rear bar section 47, fitted on bar 45, elastic cord 48 is shown centered in rear section 47. A slight twist of bow handle 41 to the left will cause rear bar section 4 to move to the right, relative to cord 48, and cause the cord to touch the side of section 47 at point 48*a*. Similarly, a slight twist of bow handle 41 to the right will move rear bar section 47 to the left and contact the cord at point 48*b*. These movements of the rear sections of the bar are relatively small and, hence are rather difficult to observe.

Figure 6:
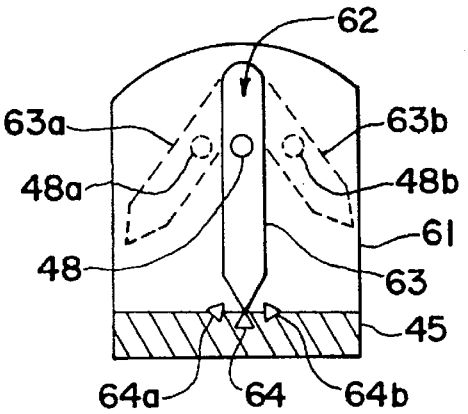

In another refinement, shown in FIG. 6, a plate 61, is attached to the end of bar 43 in place of the rear section 47, and fitted with pivot pin 62 and pointer 63. Small twists of the handle cause movement of plate 61 relative to cord 48. The cord, in turn, causes the pointer 63, to move relative to plate 61, to a position such as 63*a* or 63*b*. The pointer movements are more readily discerned.

In a further enhancement of visibility, a battery, conductors wires, and lights, not shown, may be placed in an electrical circuit together with pointer 63 and any of contacts 64, 64*a*, and 64*b*, whereby a light signal, colored or plain, may be employed as an indicator to twist, or lack thereof.

In another effective embodiment of this invention, shown in FIG. 7, a support plate 71, having a rectangular opening situated centrally therein, is attached to the end of bar 45 in place of the rear section 47. The left and right sides of the rectangular opening are fitted with conductor strips 72*a* and 72*b*, respectively. A portion of elastic connecting line 48, passing through the rectangular opening, is replaced with a conducting wire for example, a 14-gauge solid, copper wire, and placed in an electrical circuit. This permits lights to indicate the extent of torque being experienced in response to the grasp of the bow handle by the archer.

In the embodiment shown in FIG. 7, clearance between either of the conductor strips 72*a* and 72*b* and the conducting wire 48 is generally from about 0.0005 to about 0.02 inch, most often from about 0.001 to about 0.01 inch.

A complete electrical circuit for FIG. 7 is shown in FIG. 8. An insulating support plate 81, similar to plate 71 of FIG. 7, is attached to the rear end of bar 45. The rectangular opening in plate 81 is similarly fitted with conductor strips 82*a*and 82*b*, respectively. A conducting wire 88, attached to elastic connector line 89, passes through the rectangular opening in plate 81 and extends to the front end of bar 45 where it is anchored on insulating support 85. The electrical circuit includes lights 83*a* and 83*b*, mounted on plate 81; second conducting wire 84 and branches 84*a*and 84*b*, thereof, leading through respective lights 83*a*and 83*b* to conductor strips 82*a*and 82*b*; battery 86; original conducting wire 88; and on-off switch 87. The circuit is closed when a branch of second conducting wire 84 is in contact with either of conductor strips 82*a*or 82*b*, thus serving to light up either light 83*a*or corresponding light 83*b*.

In still another embodiment of this invention, the conducting wire is contained within a hollow bar or tube. This is shown in FIG. 9 where the mechanism described in FIG. 8 is enclosed by hollow tube 91 and support plate 81. This simplifies both the mounting on the bow handle and the making of electrical connections while protecting the conducting wire. The wire is connected to the bow string by a section of elastic cord.

Figure 10:
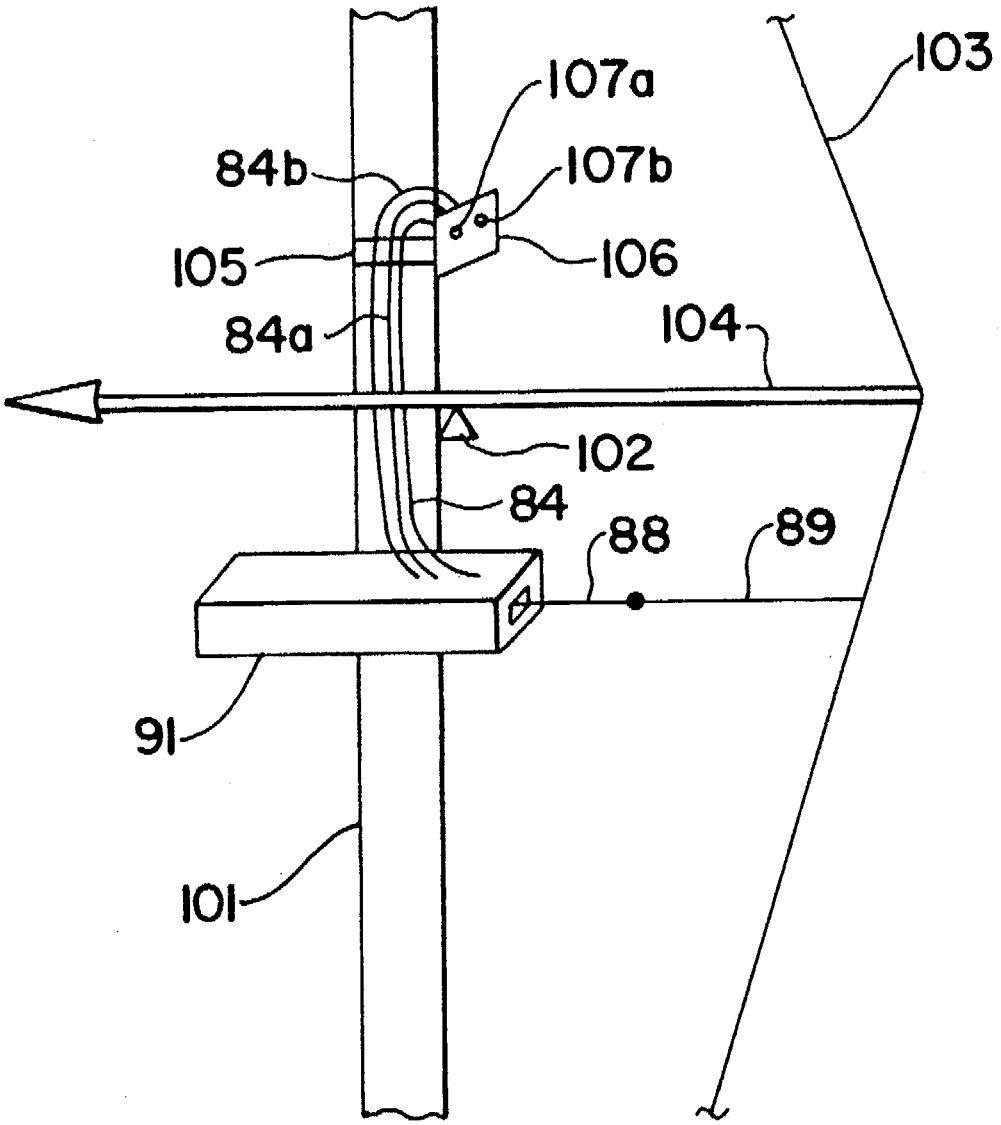

When incorporation of an electrical signal lighting system is feasible, it is to be preferred because of the enhanced visibility of the signal to the archer. One such embodiment is shown in FIG. 10 where, in contrast to FIG. 4, the bar attachment of the torque sight is located below the hand grip. Bow handle 101, arrow rest 102, and bow string 103 serve to position arrow 104. The bar is exemplified by hollow tube 91, with conducting wire 88 and elastic connector line 89, from which wires 84, 84*a*, and 84*b* extend upwardly along bow handle 101 to clamp 105 and plate 106, which contains lights 107*a*and 107*b*.

Light emitting diodes (LED) are especially desired for inclusion in complete electrical systems. Lighting may be from any combination of colors, flashing systems, on-off arrangements, and the like. For example, colored lights may be used to indicate right, left, or zero torque.

In the practice of this invention, any convenient bar material may be employed, with the proviso that a conducting material will be required whenever the bar is a required part of an electrical circuit. The bar may be hollowed out, U-shaped, or have a channel attached to it. It may be a tube or a pipe as well as a solid section.

The elastic portion of the overall length of the connector line may preferably range from about 25% to 85% elastic material ranging up to 100% whenever no electrical circuit is included. The connector line may include an elastic cord, band, or tube.

The front and rear sections on the bar can be attached to the bow handle with supports other than a bar, but a bar or tube is preferred.

The bar may be attached to the bow handle either above or below the hand grip. Attachment below the hand grip will be most effective when an electrical circuit is employed for an indication of torque, due to the normal aiming technique employed.

Variations on the described embodiments may be employed in any effective manner for coping with accuracy problems brought about by torque parameters in hand-held bows.

I claim:

1. In an archery bow for shooting arrows having: a bow handle, including a hand grip, for grasping control by the archer, and an arrow rest; two shaped elongated bow limbs, each having a first end attached to the bow handle and a second end extending therefrom in a plane substantially co-planar with the bow handle; and a bow string, attached to the respective second ends of the bow limbs and having a length selected to hold the bow limbs under tension in a bowed condition; for receiving the rear extremity of an arrow, notched on the bow string at approximately the mid-point thereof, said arrow also being positioned upon the arrow rest to define its lateral plane, the improvement comprising:

(a) a bar attached laterally to the bow handle parallel to the arrow and having front and rear sections;

(b) an elastic, connector line, having first and second ends, attached at the first end thereof to the bar and adapted to pass along at least a portion of the length of the bar and beyond the rear section of the bar, while terminating in attachment of the second end thereof to the bow string at a point above and substantially parallel to the plane of the arrow when the bow is at full draw; and (c) signal means, supported at least in part by the bar, responsive to lateral movement of said rear section of the bar relative to the connector line;

whereby the lateral movement of the rear section of the bar activates signal means whenever a torque change occurs in the positioning of the bow handle in response to the grasping thereof by the archer when aiming an arrow.

2. The archery bow of claim 1 wherein the bar is attached to the bow handle above the hand grip.

3. The archery bow of claim 1 wherein the bar is attached to the bow handle below the hand grip.

4. The archery bow of claim 1 wherein the elastic connector line is attached at a first end thereof to the front section of the bar and adapted to pass along the length of the bar and through the rear section thereof.

5. The archery bow of claim 4 wherein the elastic connector line comprises an elastic cord.

6. The archery bow of claim 5 wherein the rear sighting section of the bar comprises a U-shaped sight and a side thereof is brought visibly closer to the elastic cord in response to a slight twist of the bow handle while aiming an arrow.

7. The archery bow of claim 5 wherein the rear sighting section of the bar includes a vertical plate, having a central opening for passage therethrough of the elastic cord and fitted with a pointer supported on a pivot pin, for enhancement of the visual indication of lateral movement in response to a slight twist of the bow handle when aiming an arrow.

8. The archery bow of claim 7 wherein the vertical plate is additionally fitted with electrical contacts lights, and a power source for supplying lighted signals indicating lateral movement of the rear section of the bar in response to a slight twist of the bow handle.

9. The archery bow of claim 5 wherein a portion of the elastic connector line comprises an electrically conducting wire.

10. The archery bow of claim 9 wherein the rear sighting section of the bar comprises a vertical plate, having a centrally positioned opening for passage therethrough of the electrically-conducting wire portion of the elastic connector line, fitted at either side of the opening with electrical contacts, lights, and a power source, for supplying illuminated signals, indicating lateral movement of the rear section of the bar, in response to a slight twist of the bow handle when aiming an arrow.

11. The archery bow of claim 10 wherein the centrally positioned opening in the vertical plate provides a clearance between the centered electrically-conducting wire portion of the elastic connector line and the electrical contacts, at either side thereof, within the range of about 0.0005 to about 0.02 inch.

12. The archery bow of claim 1 wherein the bar comprises an elongated hollow tube, fitted with electrical contacts, lights, and a power source; and the elastic connector line comprises in part an electrically-conducting wire; for supplying illuminated signals indicative of lateral movement of the respective ends of the bar relative to the elastic connector line, in response to a twisting force applied to the bow handle when aiming an arrow.

* * * * *